United States Patent [19]

Pask

[11] Patent Number: 4,521,159

[45] Date of Patent: Jun. 4, 1985

[54] LOAD DISTRIBUTION MEMBER

[75] Inventor: George Pask, Derby, England

[73] Assignee: Rolls-Royce Limited, London, England

[21] Appl. No.: 496,669

[22] Filed: May 20, 1983

[30] Foreign Application Priority Data

Jun. 10, 1982 [GB] United Kingdom ..... 8216915

[51] Int. Cl.[3] ..... F01D 11/00

[52] U.S. Cl. ..... 416/174; 415/173 R; 415/174; 277/212 F

[58] Field of Search ..... 416/174; 415/142, 113, 415/170 R, 172 R, 172 A, 173 R, 173 A, 174; 277/212 F, 212 C, 212 R; 248/560; 60/39.36

[56] References Cited

U.S. PATENT DOCUMENTS

| | | | |
|---|---|---|---|
| 3,056,579 | 10/1962 | Bobo | 416/96 R |
| 3,209,838 | 10/1965 | Frankel | 416/191 |
| 3,245,734 | 4/1966 | Morley | 416/174 |
| 3,314,648 | 4/1967 | Howald | 415/115 |
| 3,422,902 | 1/1969 | Bouchillon | 277/212 |
| 3,733,146 | 5/1973 | Smith et al. | 415/172 A |

*Primary Examiner*—Robert E. Garrett
*Assistant Examiner*—H. Edward Li
*Attorney, Agent, or Firm*—Cushman, Darby & Cushman

[57] ABSTRACT

A load distribution member for the turbine of a gas turbine engine comprises an annular diaphragm between regions $P_1$ and $P_2$ of high and low gas pressure respectively which is in the form of a part of a complete thin shelled toroid having a circular cross-section area of revolution. The radially outer edge of the annular diaphragm has a ring member attached thereto which is attached in turn to the undersides of an annular array of stator aerofoil vanes. The radially inner edge of the annular diaphragm has a ring member attached thereto which carries one element of an annular gas seal. The other element of the seal is attached to a rotary part of the turbine. The configuration of the part-toroid shape of the diaphragm is selected so that the axial forces exerted by the diaphragm upon the radially inner ring member are zero, thereby minimizing the degree of axial deflection of the seal element.

5 Claims, 7 Drawing Figures

34
33
35
45
45
44
44
49
43
48
42
38b
37b
46
37
36
P3
46
P1
38
P2
P1
40
38a
46
41
47
37a
39

LOAD DISTRIBUTION MEMBER

This invention relates to a load distribution member and in particular to a member suitable for distributing fluid loads.

It is sometimes necessary to provide a load distribution member which is in the form of a generally annular diaphragm and is interposed between areas of high and low fluid pressure. The outer periphery of the diaphragm is attached to a first support member and its inner periphery attached to a second support member. The arrangement is such that the pressure drop across the diaphragm causes it to impose a load which is shared between the first and second support members.

The distribution of the loads imposed by the diaphragm upon the support members is governed by the geometry of the various components involved. It follows from this that under certain circumstances, loads may be imposed by the diaphragm upon one of the support members which necessitates the member being larger, and hence heavier, than is desirable whilst the loads imposed upon the other support member by the diaphragm are less than that member is capable of withstanding. The result of this is that the support members are probably heavier than they in fact need to be when their combined load bearing capabilities are compared with the total load imposed upon them by the diaphragm.

A further problem is associated with the directions of the loads which are imposed upon the support members. Thus the support members often need to be larger, and hence heavier, than would have been the case if the loads had been imposed upon them from different directions.

It is an object of the present invention to provide a load distribution member between areas of high and low fluid pressure which is capable of distributing both the magnitude and direction of the loads which it imposes upon one or more support members associated therewith in a pre-determined manner.

According to the present invention, a load distribution member which in operation is interposed between regions of high and low fluid pressure comprises an annular diaphragm having two circular edges, said diaphragm being so configured that when interposed between and subjected to regions of high and low fluid pressure it is in the general shape of a part of a complete thin shelled toroid having a circular cross-section area of revolution, the axis of which part toroid is coaxial with the axes of said circular edges, first and second ring members being provided to respectively engage said circular edges to provide radial constraint thereof so that the radial components of the forces exerted upon said ring members by said diaphragm as a result of the fluid pressure difference between said regions of high and low fluid pressure are absorbed by said ring members as hoop stresses, support means being provided to contain any axial components of force exerted upon at least one of said ring members by said diaphragm, the distribution of the magnitude and direction of the axial forces exerted upon said ring members being pre-determined by the configuration of the part-toroid shape of said diaphragm.

Said annular diaphragm may be of such a part-toroid configuration that one of said circular edges thereof lies at such a position that the forces exerted by said diaphragm upon the ring member which it engages are solely radial and the other of the circular edges thereof lies at such a position that the forces exerted by said diaphragm upon the ring member which it engages have both radial and axial components.

One of said ring members may carry one element of an annular fluid seal, the other corresponding element of said fluid seal being carried by remote structure, the configuration of said part-toroid being such that said ring member carrying said fluid seal element is so positioned that any axial deflection of said seal element as a result of the forces exerted upon said ring member by said diaphragm is minimised.

Two of said annular diaphragms may be used in conjunction with each other to define a chamber which, in operation, is interposed between regions of high and low fluid pressure, the interior of said chamber being in communication with a region containing fluid at a pressure which is higher than that of the fluid in said regions of high and low fluid pressure, the arrangement being such that the magnitude and direction of the axial components of force exerted upon said support members by the ring members engaging said annular diaphragms are distributed between said ring members in a manner pre-determined by the configurations of the part-toroid shapes of said annular diaphragms.

Said part-toroid annular diaphragms may be situated one each side of a bearing support panel which constitutes a part of the turbine of gas turbine engine so as to at least partially enclose said bearing support panel and be coaxial with the longitudinal axis of said turbine, said panel having spokes which extend through radial passages provided within an annular array of stator vanes provided within said turbine to engage the casing of said turbine, the radially inner rings of said diaphragms being attached to the radially inner regions of said bearing support panel, the radially outer rings of said diaphragms being attached to the radially inner regions of said stator vanes whereby the loads imposed upon said diaphragms as a result of the pressure differences between said regions of different pressures are distributed between said bearing panel and said stator vanes in a manner which is pre-determined by the configurations of the part-toroid shapes of said diaphragms.

Said ring members may be integral with their associated annular diaphragm.

The invention will now be described, by way of example, with reference to the accompanying drawings in which.

Figure 1:
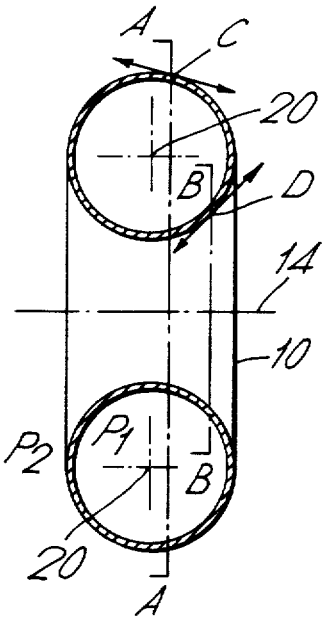
FIG. 1 is a sectional view of a thin shelled toroid having a circular cross-section area of revolution

With reference to FIG. 1 a thin shelled toroid 10 which has a circular cross-section area of revolution is shown in longitudinally sectional form in order that the internal structure thereof may be seen. It will be understood however that although the toroid and part-toroids which are shown in this and the remaining figures are shown in longitudinally sectioned form, this is only to illustrate their general structure and that the toroid and all of the part-toroids which are shown in the figures are in fact fully annular.

If the toroid is pressurised by a fluid so that the region $P_1$, within it is at a greater pressure than that in the region $P_2$ externally thereof, then all of the stresses within the wall of the toroid 10 will be hoop stresses. Thus if the forces at arbitrary points C and D on the surface of the toroid are considered, those forces will be tangential in direction as indicated by the arrows.

Figure 2:
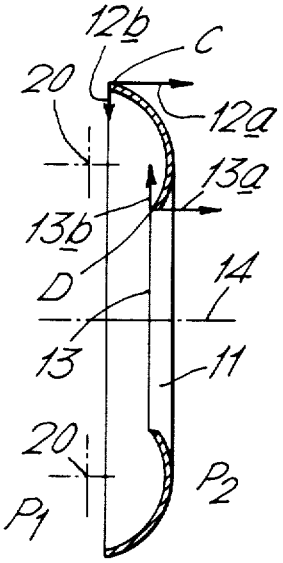
FIG. 2 is a view of the toroid shown in FIG. 1 with a portion thereof removed

If the toroid 10 is then divided along the section lines A—A and B—B which are normal to the axis 14 of the toroid 10 and pass through the points C and D, then the resultant part toroid will appear as an annular diaphragm 11 as shown in FIG. 2. Thus the diaphragm 11 will have two circular edges 12 and 13 which are each coaxial with the axis 14 of the diaphragm 11.

If it is assumed that a pressure difference still exists between the regions $P_1$ and $P_2$ then the diaphragm 11 will tend to distort from its part-toroid form as a result of the release of the hoop stresses within the wall of the toroid 10. More specifically the forces at the circular edges 12 and 13 will now have both axial and radial components 12*a* and *b* and 13*a* and *b*.

Figure 3:
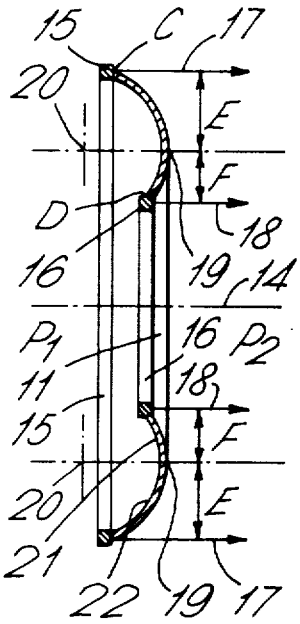
FIG. 3 is a view of the part-toroid shown in FIG. 2 with ring members attached to the edge thereof

This tendency to distort is resisted by attaching ring members 15 and 16 to the edges 12 and 13 respectively as can be seen in FIG. 3. The ring members 15 and 16 respectively provide radial constraint of the edges 12 and 13 by absorbing as hoop stresses the radial components of the forces exerted by the diaphragm 11. However, the axial components of the forces exerted by the diaphragm 11 result in the ring members 15 and 16 exerting axial forces in the directions indicated by the arrows 17 and 18. Consequently if the rings 15 and 16 are anchored to fixed support means (not shown) then the forces exerted on those support means will be solely axial.

If the part-toroid 11 of FIG. 3 is nominally radially divided along a circumferential line 19 which is the same radial distance from the part-toroid axis 14 as the centre 20 of the area of revolution of the complete toroid 10, the radially inner and outer annular coaxial part-toroid portions 21 and 22 are defined. Now the axial force exerted by the radially outer ring member 15 is proportional to the projected surface area of the part-toroid 11 which extends from the ring member 15 to the circumferential line 19 i.e. area E. Likewise the axial force exerted by radially inner ring 16 is proportional to the projected surface area of part toroid 11 which extends from ring member 16 to circumferential line 19 i.e. area F. It therefore follows that by suitable choice of the radial position of the edges 12 and 13 and hence the ring members 15 and 16, and centre 20, the load distribution between the ring members 15 and 16 of the axial loads exerted thereby may be altered. Consequently it is the configuration of the part-toroid shape of the diaphragm 11 which determines the positions of the edges 12 and 13 and hence the distribution of the axial loads exerted by the ring members 15 and 16.

Figure 4:
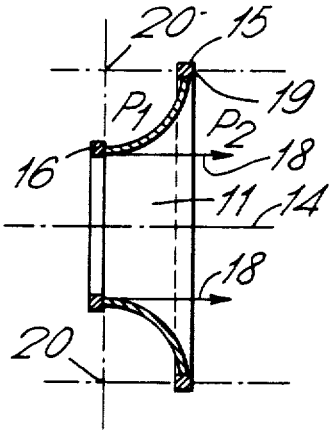
FIG. 4 is a sectional view of a part-toroid of alternative configuration to that shown in FIG. 3

In FIG. 4 there is shown a further diaphragm 11 of part-toroid form which is interposed between regions $P_1$ and $P_2$ of high and low fluid pressure. In this particular case, the radially outer ring member 15 is located on the circumferential line 19 which is the same radial distance from the toroid axis 14 as the centre 20 of the area of revolution of the complete toroid 10. This being so, all of the forces exerted by the diaphragm 11 upon the radially outer ring member 15 are radial and therefore absorbed by the ring member 15 as hoop stresses. There are therefore no axial forces exerted by the ring member 15. Similarly there are no radial forces on ring 16. All axial forces are exerted by the radially inner ring member 16 in the direction indicated by the arrows 18, and all radial forces are on ring 15.

Figure 5:
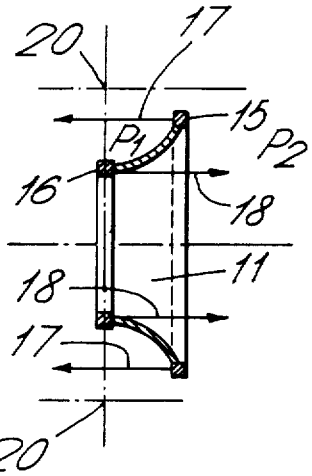
FIG. 5 is a sectional side view of a part-toroid of alternative configuration to that shown in FIG. 3

A yet further diaphragm 11 of part-toroid form which is interposed between regions $P_1$ and $P_2$ of high and low fluid pressure is shown in FIG. 5. The diaphragm 11 in this particular case is still of part-toroid form but it constitutes a different portion of a complete toroid from the part-toroids shown in FIGS. 3 and 4. This provides that the force indicated by the arrow 17 which the diaphragm 11 imposes upon the ring member 15 differs in direction from that in the case of the diaphragms 11 shown in FIGS. 3 and 4. More particularly, whilst the radial components of those forces are absorbed by the ring member 15 as hoop stress, the axial component of 15 is opposite in direction to the axial forces exerted in the cases of the part-toroids shown in FIGS. 3 and 4. It follows from this that by making an appropriate selection of the configuration of the part-toroid shape of the diaphragm 11, it is possible to choose both the distribution of the axial forces which are exerted by the ring members 15 and 16 and also their direction.

Figure 6:
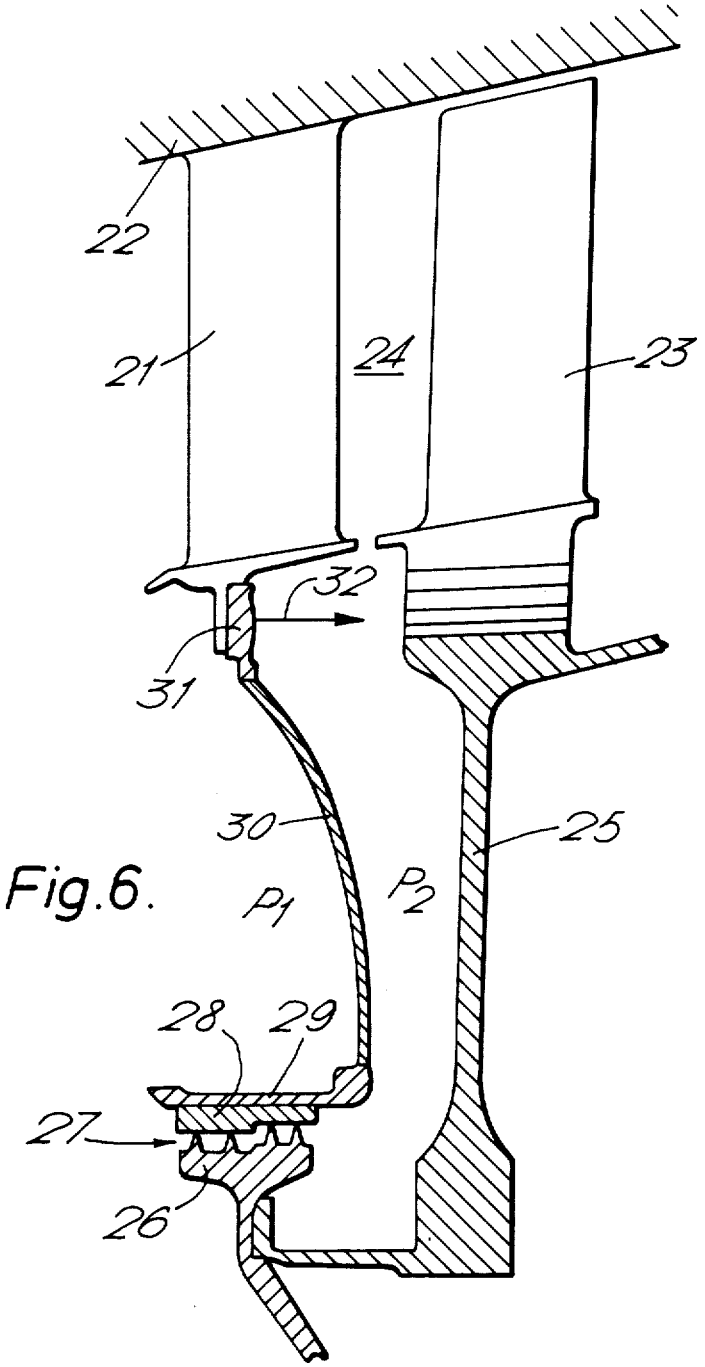
FIG. 6 is a sectional side view of a part of a gas turbine engine which incorporates a load distribution member in accordance with the present invention

A typical application of a load distribution member in accordance with the present invention is shown in FIG. 6. In FIG. 6 there is shown a part of the turbine of a gas turbine engine. More particularly there is shown an annular array of turbine stator aerofoil vanes 21 which are attached at their radially outer extents to the casing 22 of the turbine and are suited adjacent and upstream of an annular array of rotor aerofoil blades 23. The stator vanes and rotor aerofoil blade 21 and 23 are situated in an annular gas passage 24 which extends through the turbine and which in operation carries the motive fluid passing through the turbine.

The rotor aerofoil blades 23 are mounted on a disc 25 which is attached to a rotary shaft (not shown) and carries one element 26 of an annular gas seal. The other element 28 of the gas seal 27 is stationary and is carried by a first ring member 29 which is attached to the radially inner edge of an annular diaphragm 30. The radially outer edge of the annular diaphragm 30 is carried by a second ring member 31 which is attached in turn to the radially inner portions of the stator vanes 21. The annular diaphragm 30 is interposed between regions $P_1$ and $P_2$ of respectively high and low gas pressure, the gas seal providing a seal between those regions.

The annular diaphragm 30 is in the form of a part-toroid and therfore embodies the properties of part-toroids interposed between regions of high and low pressure described previously. Thus the radial forces imposed by the diaphragm 30 upon the ring members 29 and 31 by virtue of the pressure drop across it are absorbed by the ring members 29 and 31 as hoop stresses. However the annular diaphragm 30 is so configured that the axial forces which it exerts are concentrated at the radially outer ring member 31 as indicated by the arrow 32. This being so, the axial forces at the radially inner ring member 29 are zero, thereby minimising the amount by which the seal element 28 is axially deflected and consequently maintaining the efficiency of the seal 27.

The alternative to a diaphragm 30 which is of part-toroidal form as described above is one which is of frusto-conical form. However such a frusto-conical diaphragm would, in order to achieve the minimal axial deflection of its radially inner edge, have to be of greater thickness than that of the part-toroid diaphragm 30 of the present invention, because unlike the diaphragm 30, it would have bending forces exerted upon it. Calculations have in fact shown that for a typical turbine of a gas turbine engine, a 50% reduction in weight can be achieved with use of a part-toroid diaphragm 30 instead of a frusto-conical diaphragm.

Figure 7:
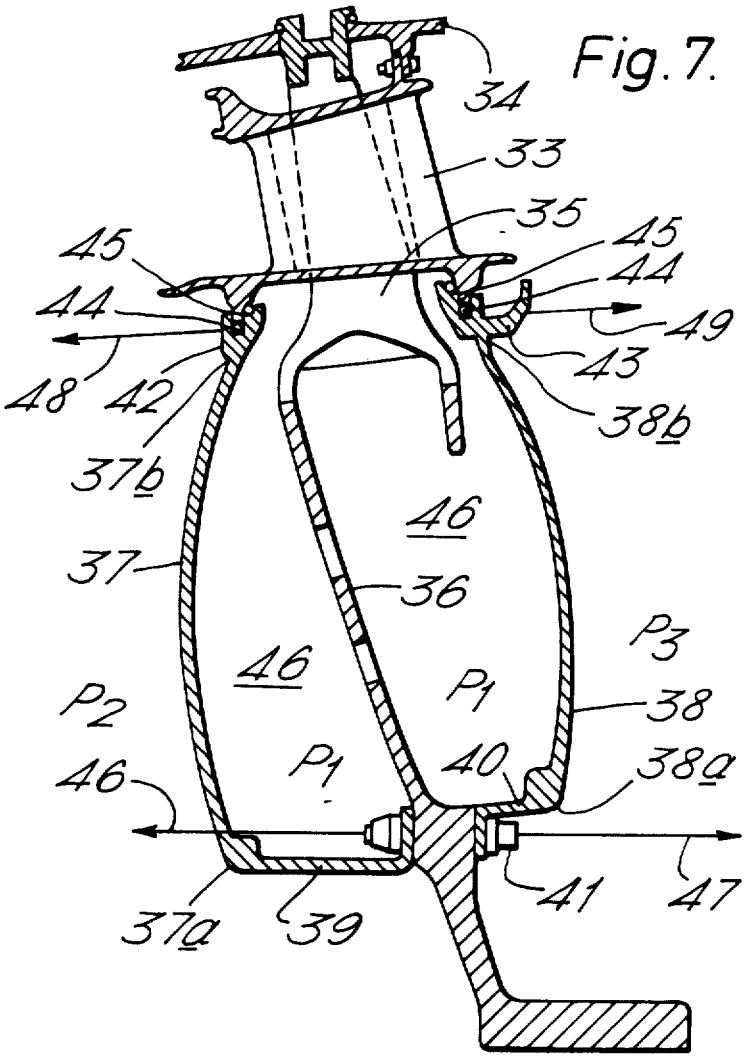
FIG. 7 is a sectional side view of a further part of a gas turbine engine which incorporates two load distribution members in accordance with the present invention.

A further application of a load distribution member in accordance with the present invention is shown in FIG. 7. FIG. 7 also shows a part of the turbine of a gas turbine engine but in this particular case shows an array of stator vanes 33 only. The stator vanes 33 are nozzle guide vanes and are attached at their radially outer extents to the casing 34 of the turbine. Each of the vanes 33 has a radially extending passage through it to accommodate the radially extending spokes 35 of a bearing support panel 36. The bearing support panel 36 carries a bearing (not shown) at its radially inner extent and is attached at its radially outer extent to the turbine casing 34 by means of its spokes 35.

The bearing support panel 36 has two annular diaphragms 37 and 38 attached to each side thereof at its radially inner extent. More particularly the annular diaphragms 37 and 38 are provided at their radially inner edges 37*a* and 38*a* with integral ring members 39 and 40 respectively which are flanged so as to effect a gas tight seal between the ring members 39 and 40 and the bearing support panel 36. An array of mechanical fasteners 41 maintain the ring members 39 and 40 in engagement with the bearing support panel 36.

The radially outer edges 37*b* and 38*b* of the annular diaphragms 37 and 38 are respectively provided with integral ring members 42 and 43. The ring members 42 and 43 are respectively provided with annular grooves 44 which receive corresponding axially spaced apart flanges 45 on the radially inner portions of the vanes 33 in sealing engagement. Thus the annular diaphragms 37 and 38 cooperate to define an chamber 46 around a major portion of the bearing support channel.

The chamber 46 has access to the interiors of the vanes 33 and consequently the gas pressure $P_1$ within the chamber 46 is the same as that within the vanes 33. Since the gas pressure within the vanes is high for the purposes of vane cooling, then the gas pressure within the chamber 46 is correspondingly high. More particularly the gas pressure in the region $P_1$ within the chamber 46 is higher than the gas pressures in the regions $P_2$ and $P_3$ externally of the annular diaphragms 37 and 38 respectively.

The annular diaphragms 37 and 38 are each in the form of part-toroids and therefore embody the properties of part-toroids interposed between regions of high and low pressure described previously. This being so, the radial loads imposed upon the diaphragms 37 and 38 by virtue of the pressure drops across them are absorbed as hoop stresses by the ring members 39, 40, 42 and 43. The axial loads imposed by the diaphragms 37 and 38 cause the ring members 39 and 40 to exert opposing axial forces in the directions indicated by the arrows 46 and 47 upon the radially inner portion of the bearing panel 36 since the pressure within the region $P_2$ is greater than within the region $P_3$. Consequently there is a net force in the direction indicated by the arrow 47. Similarly the axial loads imposed by the diaphragms 37 and 38 cause the ring members 42 and 43 to exert opposing axial forces upon the radially inner portions of the vanes 33 in the directions indicated by the arrows 48 and 49. Since the pressure within the region $P_2$ is greater than that within the region $P_3$, then there is a net force upon the radially inner portions of the vanes 33 in the direction indicated by the arrow 49.

It will be seen therefore that the axial forces exerted by the annular diaphragms 37 and 38 are distributed between the bearing panel 36 and the vanes 33. The manner in which those axial forces are so distributed is governed by the configurations of the part-toroid shapes of the annular diaphragms 37 and 38. In this particular case, the part-toroid configurations are chosen so that the axial loads imposed upon the bearing panel 36 are such as to enable the bearing panel spokes 35 to be made sufficiently small that they will pass through vanes 33 which are of optimum aerodynamic configuration. Thus if the annular diaphragms 37 and 38 were not present and the region $P_1$ of highest pressure were to be confined within the vanes 33, the bearing panel 36 would be subject to axial forces resulting from the pressure differences between the areas $P_2$ and $P_3$. This would in turn necessitate that the bearing panel spokes 35 would have to be of such a size that a compromise would have to be made in the aerodynamic configurations of the vanes 33 to enable them to pass through the vanes 33. It will be seen therefore that the annular diaphragms 37 and 38 of the present invention enable the distribution of axial loads between the vanes 33 and the bearing panel 36 in a manner which permits both the vanes 33 and the bearing panel 36 to be of optimum size and configuration having regard to their functions.

Although the present invention has been described with reference to load distribution members for use in distributing the loading upon a seal carrier and bearing support panel, it will be appreciated that is also applicable to other gas turbine engine applications and indeed to non-gas turbine engine applications where it is necessary to distribute the forces exerted by an annular diaphragm between high and low pressure regions in a pre-determined manner.

It will also be appreciated that the manner in which the ring members are attached to the annular diaphragm is no matter of choice. Thus the ring members may be mechanically attached, bonded, welded etc. Alternatively they may be integral with the diaphragm.

The properties of part-toroid diaphragms described above are of course only possible if the diaphragm is in the form of a part-toroid when it is interposed between regions of high and low fluid pressure. This being so, it may be necessary in certain situations to configure the diaphragm in such a manner that only when it is interposed between the regions of high and low fluid pressure does it adopt the general shape of part of a complete thin shelled toroid having a circular cross-section area of revolution.

I claim:

1. Two load distribution members defining a chamber therebetween, said chamber being operationally interposed between regions of high and low fluid pressure, said chamber further having an interior containing fluid at a pressure which is higher than that of fluid in said regions of high and low fluid pressure, each of said load distribution members comprising:

an annular diaphragm having an inner circular edge and an outer circular edge of greater diameter, said diaphragm having a configuration when interposed between and subjected to said regions of high and low fluid pressure of a general shape of a part-toroid of a complete thin shelled toroid having a circular cross-section area of revolution, said part-toroid having an axis co-axial with axes of said inner circular edge and said outer circular edge;

first and second ring members respectively engaging said inner circular edge and said outer circular edge to provide radial restraint of said inner circular edge and said outer circular edge so that radial components of forces exerted upon said ring members by said diaphragm as a result of fluid pressure difference between said regions of high and low pressure fluid pressure are absorbed by said ring members as hoop stresses;

support means attached to at least one of said ring members to contain any axial components of force of said at least one of said ring members by said diaphragm, distribution of magnitude and direction of axial forces being predetermined by said configuration and shape of said part-toroid of said diaphragm when subjected to said regions of high and low fluid pressure;

and said two load distribution members having an arrangement such that magnitude and direction of axial components of force exerted upon said support means by said ring members engaging each of said annular diaphragms are distributed between each of said ring members in a manner pre-determined by configurations of the part-toroid shapes of each of said annular diaphragms.

2. Two load distribution members as claimed in claim 8 wherein each of said annular diaphragms is of such part-toroid configuration that one of said circular edges thereof lies at such a position that the forces exerted by said diaphragm upon the ring members which it engages are solely radial and the other of the circular edges thereof lies at such a position that the forces exerted by said diaphragm upon the ring member which it engages have both radial and axial components.

3. Two load distribution members as claimed in claim 1 wherein said part-toroid annular diaphragms are situated one each side of a bearing support panel of the turbine of a gas turbine engine so as to at least partially enclose said bearing support panel and be coaxial with the longitudinal axis of said turbine, said panel having spokes which extend through radial passages provided within an annular array of stator vanes provided within said turbine to engage the casing of said turbine, radially inner rings of said diaphragms being attached to the radially inner regions of said bearing support panel, the radially outer rings of said diaphragm being attached to the radially inner regions of said stator vanes whereby the loads imposed upon said diaphragms as a result of the pressure differences between said areas of different pressures are distributed between said bearing panel and said stator vanes in a manner which is pre-determined by the configurations of the part-toroid shapes of said diaphragms.

4. Two load distribution members as claimed in claim 1 wherein said ring members are integral with their associated annular diaphragm.

5. Two load distribution members as claimed in claim 1 wherein said load distribution members constitute a part of a gas turbine engine.

* * * * *